US007112002B2

(12) United States Patent
Susini et al.

(10) Patent No.: US 7,112,002 B2
(45) Date of Patent: Sep. 26, 2006

(54) LIPSTICK MECHANISM OR THE LIKE WITH FRICTIONAL BRAKING

(75) Inventors: Claude Susini, Vers (FR); Bernard Boulogne, Metz-Tessy (FR)

(73) Assignee: Rexam Reboul, (FR)

( * ) Notice: Subject to any disclaimer, the term of this patent is extended or adjusted under 35 U.S.C. 154(b) by 196 days.

(21) Appl. No.: 10/473,659

(22) PCT Filed: Apr. 10, 2002 (Under 37 CFR 1.47)

(86) PCT No.: PCT/FR02/01255

§ 371 (c)(1), (2), (4) Date: Aug. 4, 2004

(87) PCT Pub. No.: WO02/087385

PCT Pub. Date: Nov. 7, 2002

(65) Prior Publication Data

US 2006/0056902 A1 Mar. 16, 2006

(30) Foreign Application Priority Data

Apr. 27, 2001 (FR) ..... 01 05698

(51) Int. Cl.
*B43K 21/00* (2006.01)
*B43K 21/08* (2006.01)

(52) U.S. Cl. ..... 401/80; 401/78

(58) Field of Classification Search ..... 401/68, 401/75, 77, 78, 80

See application file for complete search history.

(56) References Cited

U.S. PATENT DOCUMENTS

| | | | | |
|---|---|---|---|---|
| 3,124,245 | A | 3/1964 | Hopgood | |
| 3,539,266 | A | 11/1970 | Hultgren | |
| 5,172,993 | A * | 12/1992 | Ackermann et al. | 401/69 |
| 5,186,560 | A | 2/1993 | Holloway | |
| 5,186,561 | A | 2/1993 | Ackermann et al. | 401/78 |
| 5,324,126 | A | 6/1994 | Holloway et al. | 401/78 |

FOREIGN PATENT DOCUMENTS

| | | |
|---|---|---|
| DE | 2053268 | 5/1972 |
| EP | 0 439 381 | 1/1991 |

* cited by examiner

*Primary Examiner*—David J. Walczak
(74) *Attorney, Agent, or Firm*—Ostrolenk, Faber, Gerb & Soffen, LLP

(57) ABSTRACT

This lipstick mechanism comprising an inner tubular sleeve (1), an outer tubular sleeve (3), a stick-holder cup (2) arranged in the inner tubular sleeve (1). The inner sleeve comprises a cylindrical base (12) in the wall (21) in which are formed friction pads designed to be pressed elastically on a cylindrical bearing surface (7) linked to the outer sleeve (3), a thinned wall (23) completely surrounding the periphery of each pad (22).

6 Claims, 2 Drawing Sheets

LIPSTICK MECHANISM OR THE LIKE WITH FRICTIONAL BRAKING

This invention relates to a lipstick mechanism or the like of the type comprising an inner tubular sleeve free to rotate inside an outer tubular sleeve, the sleeves being provided with two longitudinal slots and two helical slots to guide the studs fitted on a stick-holder cup located in the inner tubular sleeve in translation, the inner sleeve being provided with elastic friction relief be pressed elastically on a cylindrical bearing surface linked to the outer sleeve in order to provide a smooth and regular rotation movement between the two sleeves. This type of mechanism is made of a plastic material and is injected moulded.

In patent EP 0 439 381 the Applicant proposed a mechanism provided with such a friction device in which the relief is formed by elastic tabs formed on an add-on ring fitted to the base of the sleeve, or even formed directly on the base of the sleeve. These tabs or lugs are arranged parallel to the centre line of the sleeve and extend along the radial outwards direction to bear on the base of the inner wall of the outer sleeve, or on a wall linked to this sleeve (possibly the decorative casing surrounding the outer sleeve). This mechanism offers fully satisfactory friction. However, this excellent quality is accompanied by a manufacturing cost that may be too high for mass production with less demanding quality requirements.

An attempt was made to make friction tabs directly in the wall of the cylindrical base, to reduce manufacturing costs by means of a unique injection moulding operation; friction relief is then formed by pads or buttons placed on part of the wall that may or may not be thinned, trapped in the wall of the cylindrical base and cut out (by moulding) to form the tab. For example, this can be seen in patents U.S. Pat. Nos. 5,186,560, 5,186,561 or U.S. Pat. No. 5,324,126 using different shapes of tabs.

However, the quality of these mechanisms is too mediocre even for mass production. Therefore, the friction quality of this type of device needs to be further improved while respecting the requirement that production is made by moulding in a single operation. This is the purpose of the invention.

The purpose of the invention is achieved by means of a lipstick mechanism or the like of the type comprising an inner tubular sleeve free to rotate inside an outer tubular sleeve, the sleeves being provided with two longitudinal slots and two helical slots to guide the studs of a stick-holder cup located in the inner tubular sleeve in translation, the inner sleeve comprising a cylindrical base in the wall of which elastic friction relief is formed designed to be pressed elastically on a cylindrical bearing surface linked to the outer sleeve, the relief being formed of pads placed on a thinned part of the wall forming the cylindrical base, characterised in that the thinned wall completely surrounds the periphery of each pad. This thinned wall advantageously consists of a thin film (of the order of 0.1 to 0.2 mm in its thinnest part), on which the pad part that is moulded to be slightly thicker than the wall of the cylindrical base, is free to "float".

The Applicant discovered that with this arrangement, a mechanism can be made in which dimensions are better controlled, leading to higher quality friction. If the tabs are arranged with cut-outs as in prior art, the Applicant realised that they cause deformations in the plastic material during moulding, either due to difficulties with the passage of injected plastic material due to reserved parts (at tapers), or due to stresses generated during shrinkage close to these reserved parts; the result is that the dimensions of the pads formed on these tabs are not guaranteed, they may be too large or too small, and therefore the tabs may apply more or less friction than is expected.

With the invention, the dimensions can be better respected, but also the buttons or pads formed on the thin film of the thinned wall form a sort of floating platform that can deform more uniformly in all directions than with a cut-out tab that is constrained to move along preferred degrees of freedom, such that very smooth and regular friction is applied, even with the unavoidable imperfections in the cylindrical wall of the outer sleeve on which they press.

Usually, the sleeve injection moulding operation consists of injection from the bottom such that there is no major technical problem in making a thin film at the base.

The arrangement of the pads according to the invention provides a relatively large pad surface area that bears entirely on the cooperating area; this large area requires only a small overthickness of the pads equal to a few hundredths of a millimeter, sufficient to apply the required friction force considering the area and the number of pads. This small overthickness prevents excessive permanent deformations of the thin film and therefore prevents creep; therefore, friction according to the invention is very stable in the long term.

Furthermore, it is easy to provide sufficient clearance at the bottom of the stick-holder cup to allow it-to pass through without it being blocked, despite the small penetration of the pads radially inwards in the thin film on which they are located, when the outer sleeve is slid onto the inner sleeve and presses on the pads through its base.

It is advantageous if the pads are grouped in pairs and if there are only two diametrically opposite pairs.

The sleeve according to the invention can be made from any plastic material used conventionally for this type of injection, depending on the required quality and cost price; inexpensive materials such as polypropylene can be used despite their tendency to creep, considering what has just been said about limitation of creep according to the invention. Naturally, more noble materials such as polyacetal resin (POM) can also be used.

The invention will be better understood after reading the following description with reference to the appended diagrammatic drawings representing an example embodiment of the device according to the invention. Other characteristics and advantages will become clear after reading the description.

Figure 1:
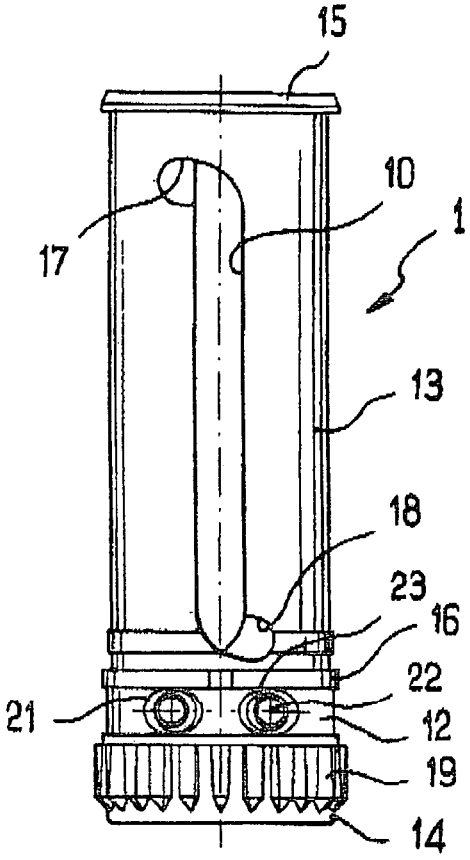
FIG. 1 is a side view of an inner sleeve of the lipstick mechanism according to the invention.
Figure 2:
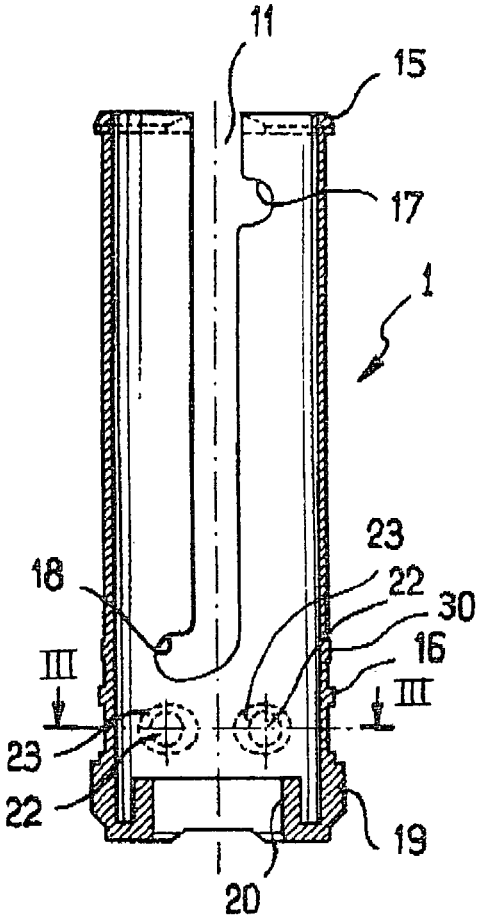
FIG. 2 is a longitudinal sectional view of this same sleeve.
Figure 4:
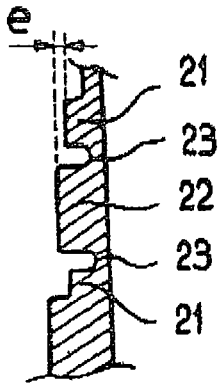
FIG. 4 is an enlarged detailed sectional view IV—IV of a pad in FIG. 3.
Figure 3:
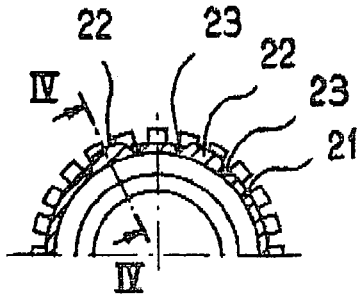
FIG. 3 is a half cross-sectional view III—III of the sleeve in FIG. 2.
Figure 5:
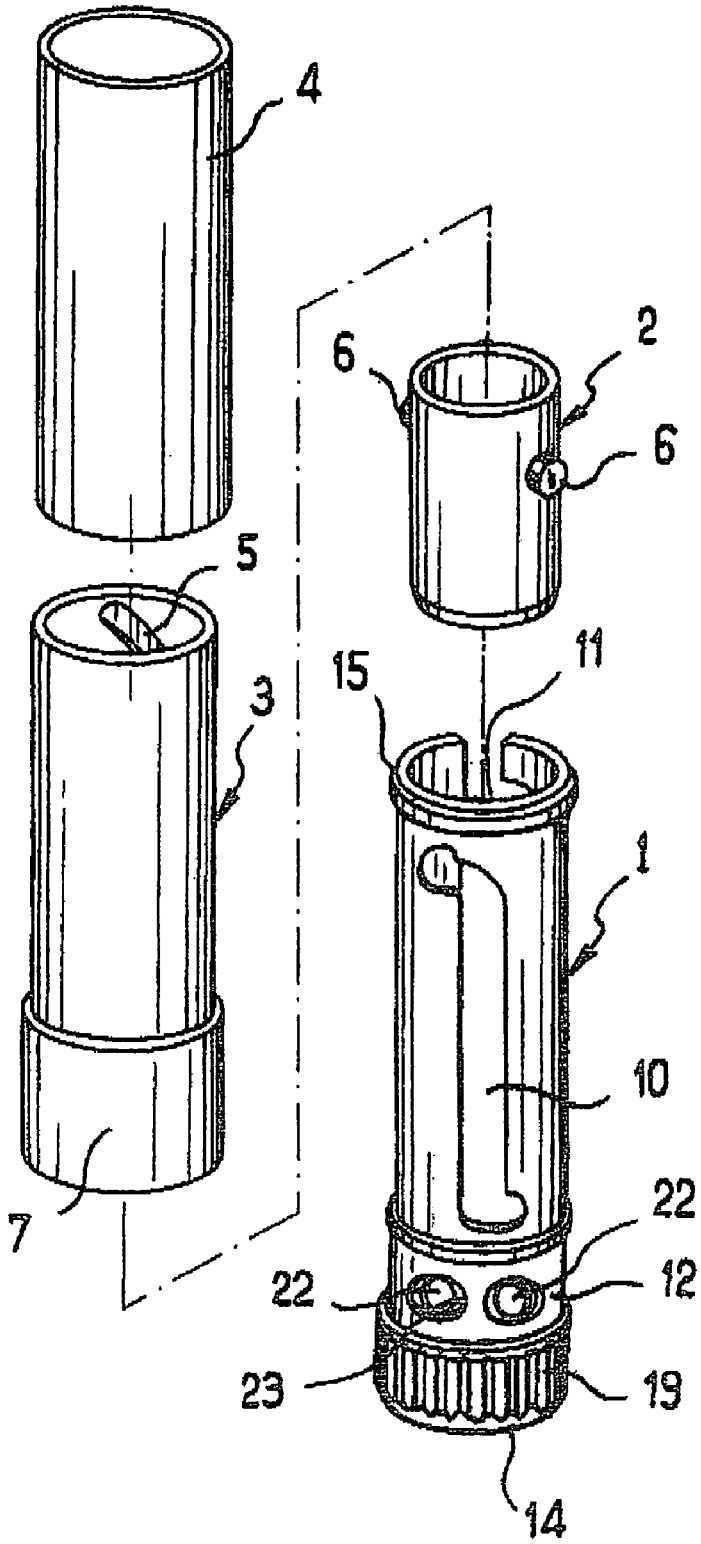
FIG. 5 is an exploded view of different components making up the mechanism in which the sleeve in FIG. 1 is fitted.

Conventionally, a lipstick mechanism comprises an inner sleeve 1 made of plastic in which the stick-holder cup 2 is fitted (FIG. 5). The outer sleeve 3 is also made of plastic and is coated with a decorative casing 4 usually made of metal or metallised plastic, and slides onto the assembly.

The inner sleeve 1 comprises two longitudinal slots 10 and 11, while the outer sleeve 3 comprises two helical slots 5 (that may only be simple grooves on its inner cylindrical face), defining an intersection area with the longitudinal slots 10, 11, into which the studs 6 on the cup 2 are engaged, the height of this area (and therefore the position of the cup 2) depending on the relative rotation of the sleeves 1 and 3.

The sleeve 3 comprises a cylindrical part 7 at its base, the inside diameter of which may be different from the inside diameter of the rest of the sleeve and that will face the bottom 12 of the inner sleeve 1 so as to cooperate with the friction pads that will now be described with reference to FIGS. 1 to 4.

The sleeve 1 comprises three areas, namely (working from top to bottom) the main area 13 on which the slots 10, 11 are formed, followed by the annular base part 12 on which the friction pads are formed, followed by the bottom 14.

The main area 13 is terminated at the top by an upper edge 15 fixing the casing 4 in place, and at the bottom by a stop collar 16 cooperating with an inner shoulder of the sleeve 4. One, 11, of the slots 10, 11 is open at the top to facilitate insertion of the studs 6 fitted on the cup 2. The slots 10, 11 comprise a top end profile 17 and a bottom end profile 18 that are deviated to block the cup at the end of its movement distance. The area 13 may comprise a very slight annular projection 30, or a convex formation a few hundredths of a millimeter high, that will centre the outer sleeve 3.

The bottom 14 comprises grooves or fluting 19 in the longitudinal direction on its outer cylindrical surface and a central passage 20 that will fix it to a decorative bottom part, without rotation.

The annular base area 12 comprises a cylindrical wall 21 (the inner face of which is continuous with the inner face of the area 13) in which friction pads 22 are formed at some locations, free to float on a thin peripheral film 23 that completely surrounds them and fixes them to the wall 21 of the area 12.

The pad 22 is a button with constant thickness (therefore consisting of a cylindrical sector) that is "e" thicker than the normal thickness of the wall 21, this extra thickness being of the order of a few hundredths of a millimeter (for example 3/100 mm), sufficient to press on the inner wall of the area 7 of the outer sleeve 3. This very small overthickness does not cause any moulding or mold removal problems after injection. The thickness of thinnest part of the film 23 is 0.1 to 0.2 millimeters, while the thickness of the wall 21 is of the order of 0.8 to 1 millimeter.

The pads 22 are arranged in two opposite pairs, each pair being centered on a longitudinal slot 10 or 11 and separated by 25° from each side of this central position. Advantageously, the pads 22 (front view) are round or oval-shaped, with the dimension of the small vertical axis being about 0.5 mm that results in a satisfactory total area of the pads.

Although the arrangement shown, in which each pad 22 is surrounded by its own thin film 23, is particularly satisfactory, it would also be possible to place the two pads of a pair floating on a single common film arranged between and around the two pads.

When the outer sleeve 3 is installed on the inner sleeve 1, the inside surface of the area 7 bears on the four pads 22 that penetrate inwards slightly due to the flexibility of the film 23 and elastically press on the said area 7 that enables the required smooth and regular rotation.

The invention claimed is:

1. Lipstick mechanism comprising an inner tubular sleeve (1) free to rotate inside an outer tubular sleeve (3), the sleeves being provided with two longitudinal slots (10, 11) and two helical slots (5) to guide the studs (6) fitted on a stick-holder cup (2) located in the inner tubular sleeve (1) in translation, the inner sleeve being provided with a cylindrical base (12) in the wall (21) of which is formed elastic friction relief designed to be pressed elastically on a cylindrical bearing surface (7) linked to the outer sleeve (3), the relief being formed of pads (22) placed on a thinned part (23) of the wall (21) of the cylindrical base, characterized in that the thinned wall (23) completely surrounds the periphery of each pad.

2. Mechanism according to claim 1, characterized in that each pad (22) has a small overthickness (e) with respect to the wall (21) of the cylindrical base.

3. Mechanism according to claim 2, characterized in that the overthickness (e) of the pad (22) is of the order of a few hundredths of a millimeter.

4. Mechanism according to claims 1, characterized in that the pads (22) are grouped in pairs.

5. Mechanism according to claim 4, characterized in that there are two opposite pairs of pads (22).

6. Mechanism according to claim 1, characterized in that the inner sleeve is made from an injected plastic material.

* * * * *